US008381451B1

(12) United States Patent
Demchak et al.

(10) Patent No.: US 8,381,451 B1
(45) Date of Patent: Feb. 26, 2013

(54) ROOF EDGE BLOCKING SYSTEM

(75) Inventors: Adam A. Demchak, Black Mountain, NC (US); William C. Webb, Fletcher, NC (US); Ricky A. Rhinehart, Candler, NC (US); Jerry D. McKinney, Jr., Weaverville, NC (US); Lisa L. McIlvoy, Atlanta, GA (US); Christopher K. McCoy, Candler, NC (US); Robert D. LeClare, Asheville, NC (US); Jeffrey F. Imes, Asheville, NC (US)

(73) Assignee: W.P. Hickman Company, Asheville, NC (US)

( * ) Notice: Subject to any disclaimer, the term of this patent is extended or adjusted under 35 U.S.C. 154(b) by 139 days.

(21) Appl. No.: 12/875,842

(22) Filed: Sep. 3, 2010

(51) Int. Cl.
*E04D 1/36* (2006.01)

(52) U.S. Cl. ..... 52/60; 52/302.3

(58) Field of Classification Search ..... 52/58, 60, 52/198, 302.1, 302.2, 302.3, 11, 12, 300
See application file for complete search history.

(56) References Cited

U.S. PATENT DOCUMENTS 4,120,122 A * 10/1978 Bahr ..... 52/58
4,601,151 A 7/1986 Nunley et al.
4,644,715 A 2/1987 Burell et al.
4,707,961 A 11/1987 Nunley et al.
4,736,561 A 4/1988 Lehr et al.
4,783,942 A 11/1988 Nunley et al.
5,584,153 A 12/1996 Nunley et al.
5,815,986 A 10/1998 Laska
5,893,247 A * 4/1999 Hickman et al. ..... 52/300
6,088,992 A 7/2000 Nunley
6,237,293 B1 5/2001 Gembala
6,250,036 B1 6/2001 Nurley et al.
6,378,256 B1 4/2002 Gembala
6,421,971 B1 7/2002 Gembala
6,494,007 B1 12/2002 Gembala
6,739,800 B2 * 5/2004 Bevilacqua ..... 405/48
6,751,923 B1 6/2004 Nunley
7,299,598 B2 11/2007 Gembala et al.
7,748,170 B1 * 7/2010 Pratt ..... 52/11
2007/0204542 A1 9/2007 Gembala
2007/0266657 A1 11/2007 Gembala
2008/0110119 A1 5/2008 Gembala
2008/0127605 A1 6/2008 Gembala

OTHER PUBLICATIONS

W.P. Hickman Company, Roof Edge Products, 1973, 4 pages, Asheville, North Carolina.
ARBS website, Alternative Roof Blocking System, Apr. 28, 2010, pp. 1-2 and 1-3, Boca Raton, Florida.
ARBS website, Alternative Roof Blocking System Data Sheets, Apr. 28, 2010, pp. 1-2, Boca Raton, Florida.
ARBS website, Alternative Roof Blocking System Perimeter Edge Blocking, Apr. 28, 2010, p. 1, Boca Raton, Florida.

(Continued)

*Primary Examiner* — William Gilbert
*Assistant Examiner* — Gisele Ford
(74) *Attorney, Agent, or Firm* — K&L Gates LLP

(57) ABSTRACT

A system for blocking an edge of a building roof structure, e.g., roof structures of cementitious material poured over a corrugated deck or roof structures of rigid insulative panels supported on a corrugated deck, comprises an elongate U-shaped base member for affixation to the deck along the roof edge, an elongate cover member of inverted U-shape for affixation over the base member, the base and cover members being made of galvanized steel or other suitable non-wood material and, as assembled together, forming an auxiliary perimeter structure on the roof structure for border containment of the roofing material.

20 Claims, 5 Drawing Sheets

OTHER PUBLICATIONS

ARBS website, Alternative Roof Blocking System Perimeter Edge Blocking with Stand-off, Apr. 28, 2010, p. 1, Boca Raton, Florida.

ARBS website, Alternative Roof Blocking System CADs, Apr. 28, 2010, pp. 1-3, Boca Raton, Florida.

* cited by examiner

ROOF EDGE BLOCKING SYSTEM

FIELD OF THE INVENTION

The present invention relates generally to roofing structures for buildings, especially commercial buildings, and more particularly relates to a system for blocking the edges of a roof structure to facilitate securement of roofing elements thereto, e.g., for border containment of a flowable cementitious roofing material, rigid insulation panels, and other roofing materials.

BACKGROUND OF THE INVENTION

In the construction of buildings with flat roofs, especially commercial buildings, a blocking system of some type is typically provided about the perimeter edge of the roof structure to act as a border for and to facilitate securement of any of various roofing elements that may commonly be utilized. For example, many conventional commercial buildings are constructed with flat roofs on which a lightweight concrete or a comparable synthetic flowable cementitious roofing material may be cast in situ. Other commercial building roofs may utilize rigid insulation boards or panels which may be made of wood fiber, perlite, polyisocyanurate, polystyrene (expanded or extruded), cellular glass, gypsum board, and composites. A perimeter edge blocking system provides a containment border within which the roofing material is contained while being installed. The perimeter edge blocking system may also provide for the securement of other roofing elements, such as gravel stops, roof curbs, copings, fascia, etc.

Conventionally, roof blocking systems are fabricated of elongate wood boards nailed to the roof structure. However, wood roof blocking systems suffer several disadvantages. Wood is subject to deterioration and decay from exposure over time to the elements, particularly moisture, even when treated with preservatives. Wood also may be damaged by insects such as termites. In addition, variations commonly occur from one wood board to another due to natural physical differences in grain, knots, splintering and splitting, and wood boards are subject to warping, all of which may result in undesirable dimensional variations between differing wood boards.

All of these reasons as well as other factors make wood a less than optimal material from which to fabricate roof blocking systems. Accordingly, a need exists in the construction industry for a new form of roof blocking system made of material other than wood which will overcome the above-described problems. U.S. Pat. No. 6,237,293 proposes a roof blocking system which may be made of galvanized steel, other steel, aluminum or plastic. Alternative Roof Blocking System, located in Fort Lauderdale, Fla., produces a commercial embodiment of such roof blocking system identified by the designation "A.R.B.S." which is intended as a substitute for wood blocking systems. While the "A.R.B.S." system performs adequately for its intended purpose, the system is fabricated in a unitary one-piece configuration, which makes the system somewhat difficult to handle and to install.

SUMMARY OF THE INVENTION

It is accordingly an object of the present invention to provide an alternative system for blocking an edge of a roof structure of a building which overcomes the problems and disadvantages of roof edge blocking systems made of wood and which is easier to handle and install than the "A.R.B.S."

system. A further object of the present invention is to provide additional features and advantages not realized by either of these conventional systems.

Briefly summarized, the roof edge blocking system of the present invention provides a two-piece construction that simplifies the installation of the system. More specifically, the present roof edge blocking system comprises an elongate base member for affixation to the roof structure along the edge thereof, and an elongate cover member for affixation over the base member. The base member is of a generally U-shaped cross-sectional configuration having a lower transverse section for superposed resting abutment on and affixation to the roof structure and spaced-apart inner and outer leg sections generally upstanding from opposite lateral sides of the lower transverse section. The cover member is of an inverted generally U-shaped cross-sectional configuration having an upper transverse section for spanning across the leg sections of the base member and spaced-apart inner and outer leg sections depending from opposite lateral sides of the upper transverse section for respectively extending downwardly along outward sides of the upstanding inner and outer leg sections of the base member. Thus, the base and cover members, as assembled together, form an auxiliary perimeter structure on the roof structure for securement of roofing elements thereto.

In a preferred embodiment of the roof edge blocking system, the base and cover members, as assembled together, define an interior cavity and the respective inner leg sections of the base and cover members cooperatively define passageways into the cavity for disposition facing inwardly from the edge of the roof structure. For example, the inner leg section of the cover member may be formed therealong with a series of openings, while the inner leg section of the base member terminates adjacent the openings of the cover member as assembled together. In such an embodiment, the inner leg section of the cover member may include a lip for engagement with a terminal edge of the inner leg section of the base member. A cap member may be provided for affixation to the base and cover members as assembled together to form an end closure to the interior cavity.

According to another feature of the present roof edge blocking system, the cover member may include a spacer flange extending laterally from the inner leg section of the cover member for spacing of roofing elements on the roof structure a defined distance from the base and cover members as assembled. Another feature of the present blocking system is that the outer leg section of the cover member may include a cleat for affixation of a fascia element or coping cap. The cover member may also include a series of vents in the upper transverse section thereof.

The present roof edge blocking system is particularly adapted for use with a building wherein the roof structure has a corrugated roof deck for supporting a roofing material thereover, which may for example be a flowable cemetitious material or a rigid insulative material or a combination thereof. In such an embodiment of the present blocking system, the elongate base member is affixed to the roof deck along the edge of the roof structure. With the elongate cover member affixed over the base member, the thusly assembled base and cover members form an auxiliary perimeter structure on the roof structure for border containment of the roofing material. In turn, a portion of the roofing material may be contained within the interior cavity within the base and cover members. For example, the interior cavity within the base and cover members is adapted to receive flow of a cemetitious roofing material through the passageway openings and into the cavity with the cap member closing the end of the interior cavity to prevent escape of the material. The spacer flange extending laterally from the inner leg section of the cover member is effective for spacing of a rigid insulative roofing material a defined distance from the base and cover members as assembled. The vents in the upper transverse section of the cover member provide for escape of air as the cavity fills with the cementitious material and vents the material as it cures.

According to a further aspect of the invention, an elongate containment member is provided for affixation to the corrugated roof deck at the edge of the roof structure to dam a cementitious roofing material in the corrugations of the roof deck beneath the base member to prevent flow thereof off the edge of the roof structure.

DETAILED DESCRIPTION OF THE PREFERRED EMBODIMENTS

Figure 1:
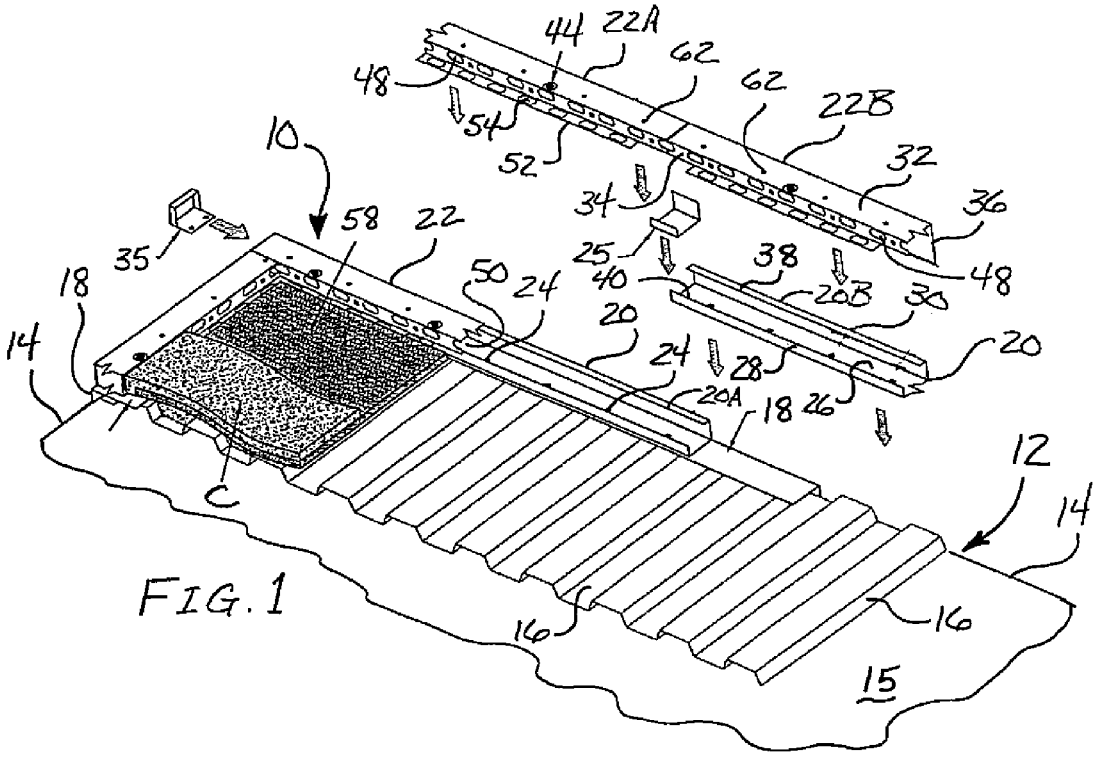
FIG. 1 is a perspective view, shown partially exploded, of a preferred embodiment of the roof edge blocking system of the present invention as installed in a lightweight concrete roof structure.
Figure 2:
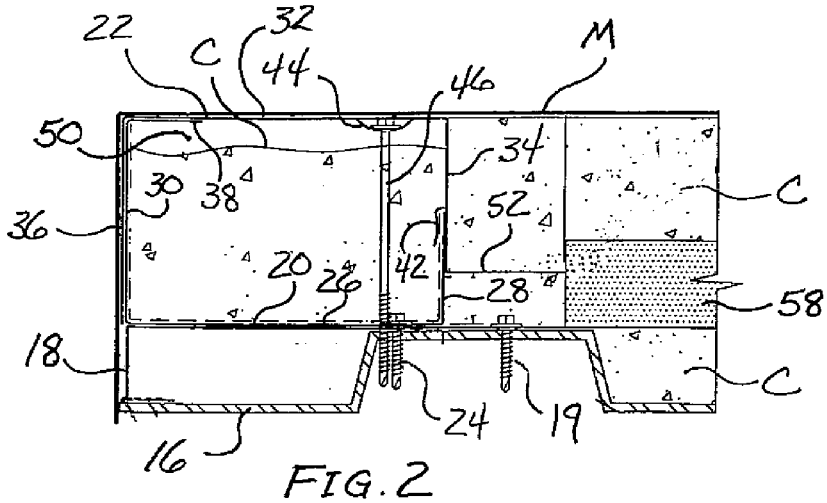
FIG. 2 is a vertical cross-sectional view of the edge blocking system in the roof structure of FIG. 1, taken along line 2-2 thereof.

Referring now to the accompanying drawings and initially to FIGS. 1 and 2, a representative preferred embodiment of the roof edge blocking system of the present invention is depicted generally at 10 as installed along an outer perimeter edge 14 of the roof structure of a commercial building indicated generally at 12. In the embodiment as illustrated, the building roof structure 12 basically comprises a poured cementitious roof system comprising a substantially flat roof sub-structure, only schematically indicated at 15, over which a corrugated deck 16 is affixed in a known conventional manner, e.g., by screws or like fasteners (not shown), for receiving a flowable cementitious roofing material, such as a lightweight concrete C, to cast in situ a monolithic roof surface on the deck 16. As more fully described hereinafter, the blocking system 10 of the present invention serves as a containment border for the cementitious material. Optionally, an angled elongate closure strip 18 is affixed via screws or other suitable fasteners 19 along the outer edges of the deck 16 beneath the blocking system 10 to cover the vertical extent of the corrugations of the deck 16 and thereby act as a dam to cementitious material in the corrugations to prevent the material from flowing off the edges of the deck 16.

Most basically, the roof edge blocking system 10 comprises an elongate base member 20 configured and adapted for affixation to the roof structure 12 along its perimeter edge 14, and a mating elongate cover member 22 configured and adapted for affixation over the base member 20. The elongate base member 20 is typically in the form of a series of plural linear base member segments, represented in FIG. 1 by base member segments 20A and 20B, arranged end-to-end along the full length of the perimeter edge 14 of the roof structure 12 and secured in place thereat to the deck 16 by a series of screws or like fasteners 24. Similarly, the elongate cover member 22 is typically in the form of a series of plural linear cover member segments, represented in FIG. 1 by cover member segments 22A and 22B, arranged end-to-end over the full length of the segments forming the base member 20. The base and cover members 20, 22 are preferably made of a material suitable to be formed with repeatable dimensional precision into a defined configuration and to be resistant to corrosion, decay and other degradation from the elements. For example, the base and cover members 20, 22 may preferably be formed of galvanized steel, but it is also contemplated that various alternative materials may be suitable, such as aluminum or plastic.

Each segment of the base member 20 is formed of a generally U-shaped cross-sectional configuration having a lower transverse section 26 with spaced-apart inner and outer leg sections 28, 30, respectively, extending in generally upstanding relation from the opposite lateral sides of the lower transverse section 26. In this manner, the lower transverse section 26 of each base member segment is adapted to be placed in superposed resting abutment on the deck 16 and affixed thereto by penetration of the screws 24 downwardly through the transverse section 26 and then through an abutting corrugation of the deck 16 at spacings along the length of each base member segment. Installation of the base member segments in this manner is easily accomplished as the U-shaped configuration of the base member segments permits clear access to the lower transverse section 26 for driving of the screws 24. Locations for the screws 24 may be pre-formed in the transverse section 26 at the same spacings as the corrugations of the deck 16 to further simplify the ease and simplicity of installation. Splice elements 25 are provided in a U-shape closely mated to that of the base member segments to be inserted at the abutting ends between adjacent base member segments to bridge over and thereby cover the abutted segment ends.

Each segment of the cover member 22 is formed of an inverted generally U-shaped cross-sectional configuration which mates with the configuration of the base member segments. Specifically, the cover member segments 22 have an upper transverse section 32 with spaced-apart inner and outer leg sections 34, 36, respectively, depending from opposite lateral sides of the upper transverse section 32. Each cover member segment is dimensioned such that its upper transverse section 32 is adapted to span across the leg sections 28, 30 of a base member segment with the inner and outer leg sections 34, 36 respectively extending downwardly along outward sides of the upstanding inner and outer leg sections 28, 30 of the base member segment.

To further facilitate secure mating of the base and cover members 20, 22, the outer leg section 30 of each base member segment is formed at its upper end with an inwardly extending flange 38 for providing a support surface on which the upper transverse section 32 of a mating cover member segment may seat in abutment when fully assembled together. The inner leg section 28 of each base member segment is of a lesser upstanding height than the outer leg section 30, terminating in an upper linear edge 40, which engages in an angled lip 42 formed on the inward surface of the inner leg section 34 of each cover member segment to similarly seat the respective inner leg sections 28, 34 of the base and cover member segments when fully assembled together. A series of recessed openings 44 are formed in the upper transverse section 32 of each cover member segment at spacings therealong to receive screws 46 which are sufficiently elongated to penetrate the mating base member segment and the corrugated roof deck 16 therebelow, to secure the base and cover members 20, 22 together as thusly assembled. The recessed character of the openings 44 allows the heads of the screws 46 to rest in countersunk manner within the recesses to be flush with the upper surface of the transverse section 32.

In this manner, the assembled base and cover members 20, 22 define a substantially open interior cavity 50 extending the full length of the blocking system 10. Each of the cover member segments is formed along its length with a series of enlarged spaced-apart openings 48 through the inner leg section 34 thereof at a location above the lip 42 to open into the cavity 50 in the assembled condition of the base and cover members 20, 22. The openings 48 are of sufficient size to permit the cementitious roofing material to flow relatively freely through the openings 48 into the interior cavity 50, as more fully described below. A cap member 35 is provided in a configuration mated to that of the interior cavity 50, for insertion of the cap member 35 into the open end of the assembled base and cover members 20, 22 to close the interior cavity thereat and thereby prevent escape of cementitious material received within the cavity 50. Vent holes are preferably formed in the upper transverse section 32 of the cover member 22 to facilitate curing of the cementitious material within the cavity 50.

Each of the cover member segments also includes a flange 52 laterally extending outwardly from the inner leg section 34 to be disposed in an essentially horizontal disposition at a spacing above the deck 16 in the installed and assembled condition of the roof edge blocking system 10. The flange 52 is formed along its length with a series of enlarged spaced-apart openings 54, similar to the openings 48, of sufficient size to permit the cementitious roofing material to flow relatively freely through the openings 54, as more fully described below.

Figure 3:
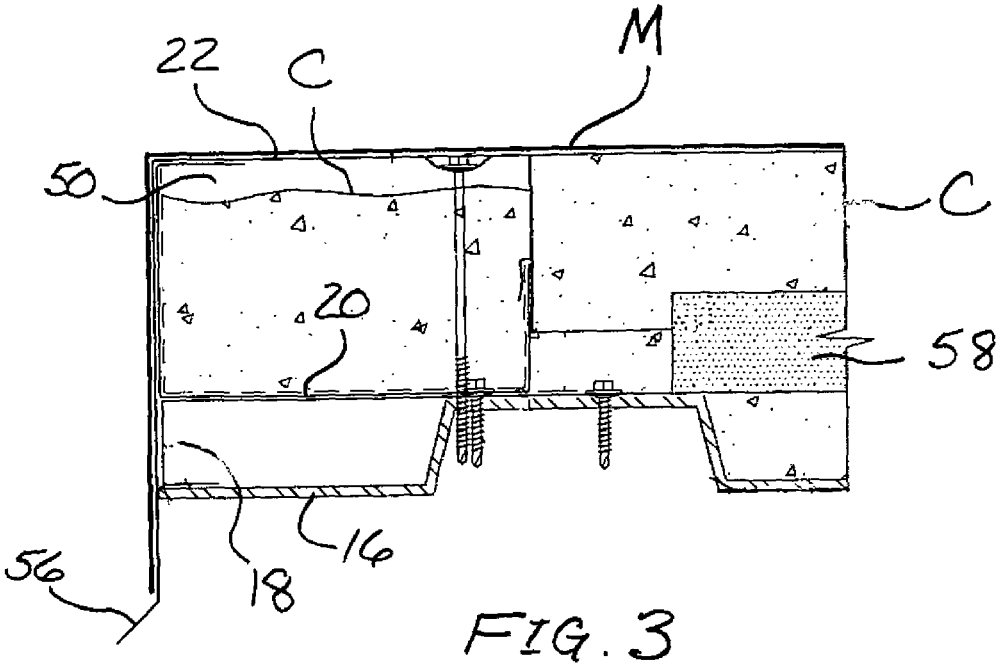
FIG. 3 is another vertical cross-sectional view similar to FIG. 2, showing an alternative embodiment of the present roof edge blocking system in a lightweight concrete roof structure.
Figure 4:
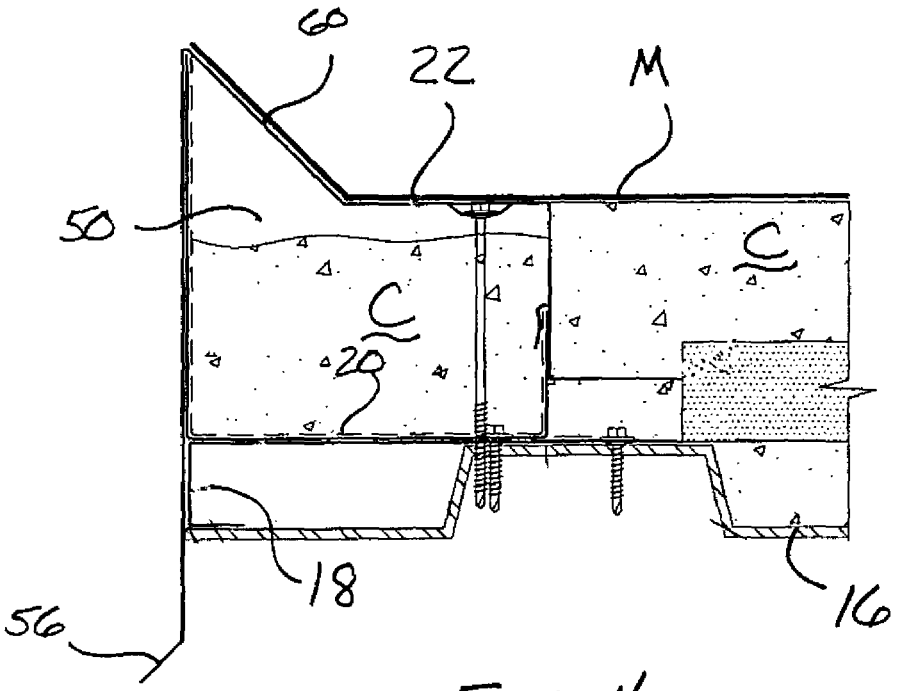
FIG. 4 is another vertical cross-sectional view similar to FIGS. 2 and 3, showing another alternative embodiment of the present roof edge blocking system in a lightweight concrete roof structure.

As best seen in FIG. 2, the outer leg section 36 of each cover member segment is of a vertical dimension sufficient at least to extend in full covering relation to the upstanding outer leg section 30 of a mating base member segment when assembled together. Optionally, as depicted in the alternative embodiment of FIG. 3, the outer leg section may be of a greater vertical dimension sufficient to extend downwardly below the closure strip 18 and to have an outwardly angled terminal edge 56 to serve as a cleat for anchoring engagement with a coping cap, fascia or other form of decorative finishing cover device over the blocking system 10. As depicted in the additional embodiment of FIG. 4, the cover member 22 may be formed with a modified U-shaped configuration in which the upper transverse section 32 has an upwardly angled outer edge portion 60 which elongates and elevates the outer leg section 36 of the cover member 22, which provides a decorative character to the blocking system 10 and also lends additional functionality, e.g., as a gravel stop.

The installation and use of the roof edge blocking system 10 may thus be understood with reference to FIGS. 1 and 2. Following the initial preparation of the substructure of the intended roof structure to install the corrugated deck 16, which is conventional, closure strips 18 are first secured by screws 19 along the outer perimeter edges of the deck 16. Multiple segments of the base member 20 are then arranged in end-to-end abutment along the full perimeter of the deck 16 in covering relation to the closure strips 18 and are secured in place to the deck 16 by screws 24. A splice element 25 is secured in place within the base member 20 in covering relation to the abutting ends of adjacent base member segments. Multiple segments of the cover member 22 are then placed end-to-end over the base member segments and seated in place with the transverse section 32 of each cover member segments in resting abutment on the flange 38 of the mated base member segment and with the lip 42 securely engaged over the terminal upper edge 40 of the inner leg section 28 of the mated base member segment. Cap members 35 are fitted into the open ends of the assembled base and cover members 20, 22, at each corner of the roof structure.

A quantity of cementitious material, typically a lightweight concrete material C, is poured and spread over the deck 16 to substantially fill the channels defined by the corrugations in the deck. Typically, a network of insulating panels 58, such as EPS (expanded polystyrene) boards, is to be embedded in the cementitious material, whereby the pouring of the material is temporarily stopped while the boards are placed across the deck 16. Importantly, the flanges 52 projecting from the cover member segments insure that the panels 58 are properly spaced from the blocking system 10. The pouring of the cementitious material is then resumed until the material covers the entirety of the panels 58 to the level of the transverse sections 32 of the cover member 22 of the blocking system 10. As the cementitious material spreads across the deck 16, the material passes through the openings 48 in the cover member segments, so as to substantially fill the interior cavity 50 defined within the base and cover members 20, 22. Likewise, the cementitious material also passes through the opening 54 in the flanges 52 of the cover member segments to fill the space beneath the flanges and adjacent the panels 58. Upon the curing of the cementitious material, the roof structure may then be finished in any desired conventional manner, e.g., by the installation of a rubber membrane M, a finishing coping or fascia, gravel, etc.

As will be understood, the blocking system 10 of the present invention is accordingly simple to handle and install. In particular, the two-piece construction of the base and cover members 20, 22 allows easy installation of fastening screws to secure the base member 20 in place to the deck 16 without the cover member 22 or any other elements obstructing access to the transverse section 26 of the base member. The cover member 22 easily and securely fits in place over the base member 20 and can then be separately secured in place via the screws 46. Advantageously, the blocking system 10 eliminates the conventional use of wood boards as part of the blocking system and thereby avoids issues of dealing with the warping or dimensional inconsistencies in wood boards as well as post-installation issues of potential decay and deterioration over time.

Figure 5:
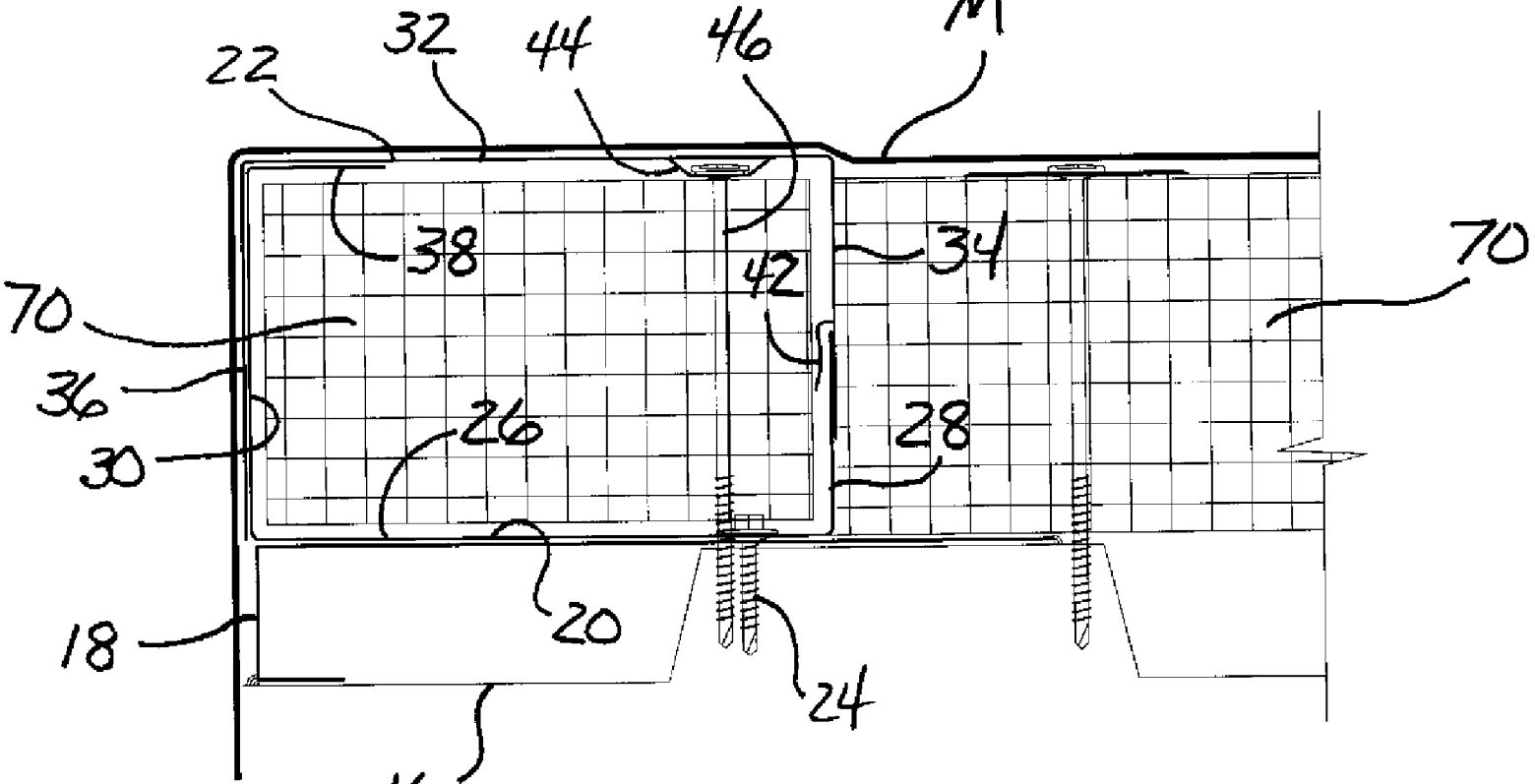
FIG. 5 is a vertical cross-sectional view, similar to FIG. 2, showing the roof edge blocking system of the present invention as installed in a roof structure comprised of rigid insulative panels.
Figure 6:
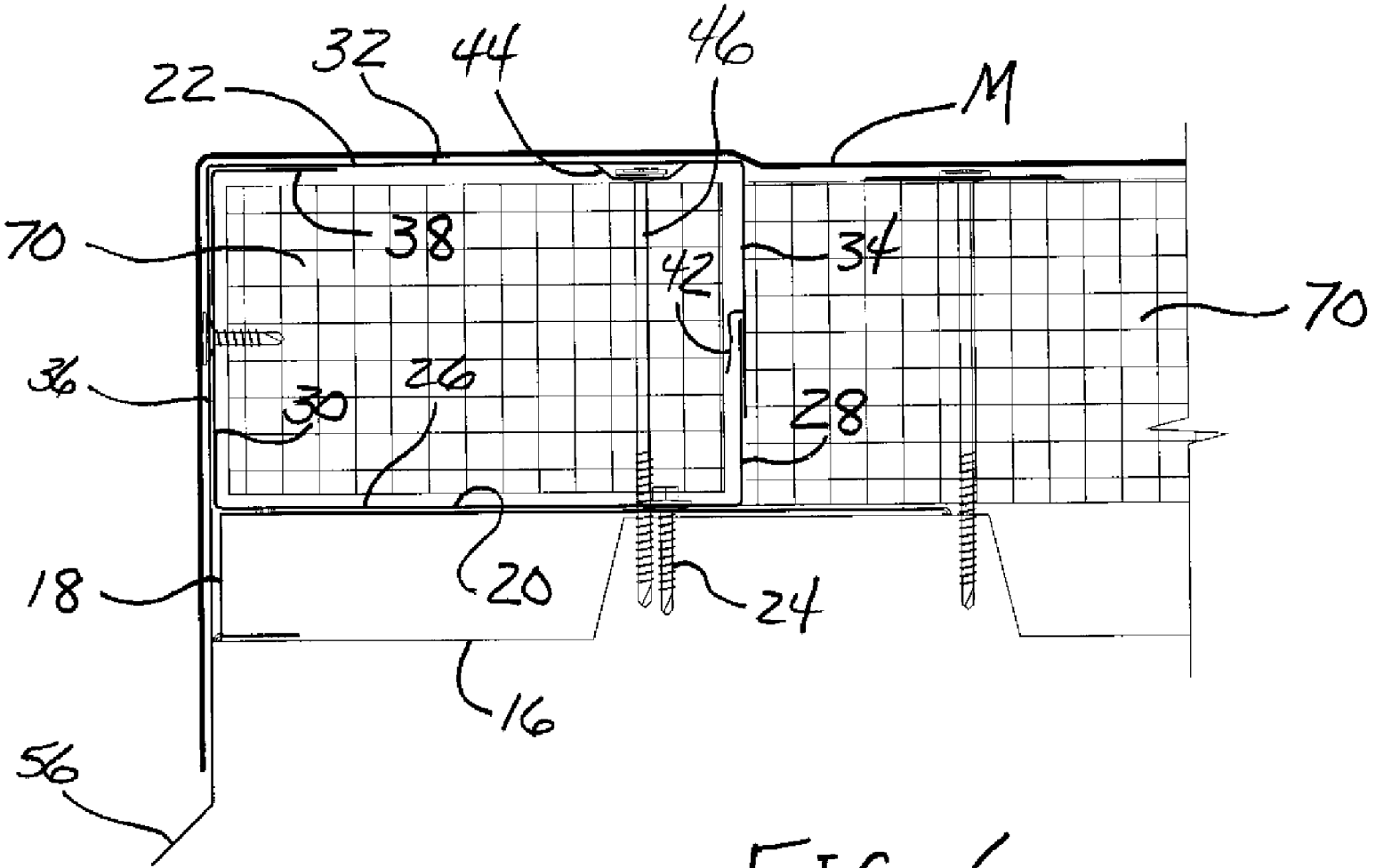
FIG. 6 is a vertical cross-sectional view similar to FIG. 5, showing an alternative embodiment of the present roof edge blocking system in a roof structure of rigid insulative panels.
Figure 7:
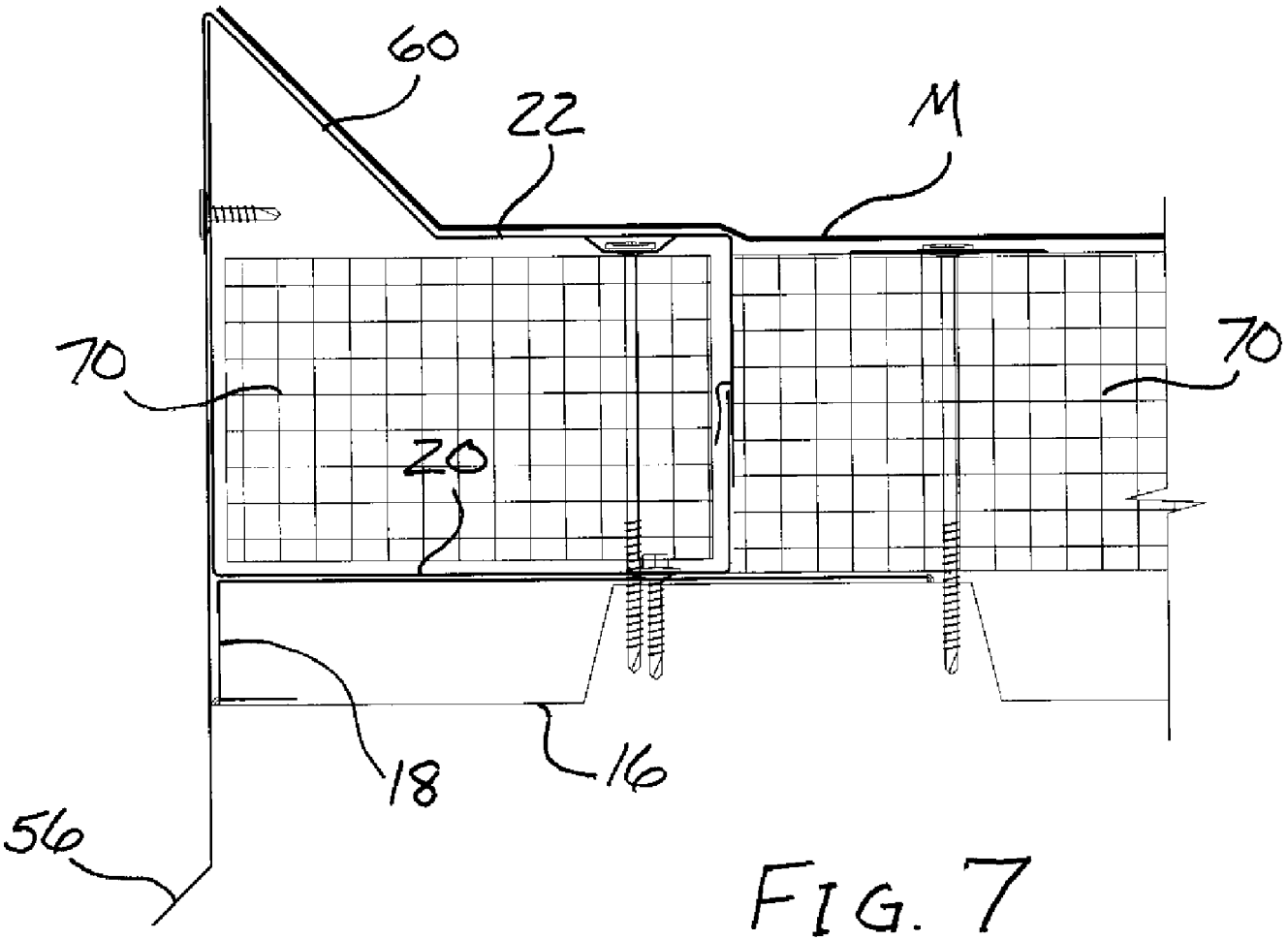
FIG. 7 is another vertical cross-sectional view similar to FIGS. 5 and 6, showing another alternative embodiment of the present roof edge blocking system in a roof structure of rigid insulative panels.

While the roof edge blocking system of the present invention has been illustrated and described in FIGS. 1-4 in differing embodiments each installed in a cementitious roof system, it is to be understood that these depictions and descriptions of the present roof edge blocking system have been provided only as representative examples of one contemplated form of roofing system for which the invention is adapted. The present roof edge blocking system however is not limited to use in such roofing systems. For additional example, FIGS. 5-7 depict comparable embodiments of the present roof edge blocking system installed in roof systems comprised of multiple rigid insulative roofing panels, indicated in each Figure at 70. The remaining elements of the roof systems in FIGS. 5-7 which are comparable to the elements in FIGS. 1-4 are identified by the same reference numerals and letters as in those Figures and do not need further description.

Those persons skilled in the art will thus recognize and understand that the invention is susceptible of broader utility and application in various forms of roof structures. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, it is to be understood that the foregoing disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In combination, a roof structure of a building, wherein the roof structure defines a roof edge, and a system blocking the roof edge, wherein the roof edge blocking system comprises:

an elongate base member affixed to the roof structure along the edge thereof, the base member being of a generally U-shaped cross-sectional configuration having a lower transverse section in superposed resting abutment on and affixed to the roof structure and spaced-apart inner and outer leg sections generally upstanding from opposite lateral sides of the lower transverse section, and an elongate cover member affixed over the base member, the cover member being of an inverted generally U-shaped cross-sectional configuration having an upper transverse section spanning across the leg sections of the base member and spaced-apart inner and outer leg sections depending from opposite lateral sides of the upper transverse section respectively extending downwardly along outward sides of the upstanding inner and outer leg sections of the base member, the base and cover members, as assembled together, forming an auxiliary perimeter structure on the roof structure for securement of roofing elements thereto.

2. The combination according to claim 1, wherein the base and cover members, as assembled together, define an interior cavity and the respective inner leg sections of the base and cover members cooperatively define passageways into the cavity facing inwardly from the edge of the roof structure.

3. The combination according to claim 2, wherein the inner leg section of the cover member is formed therealong with a series of openings and the inner leg section of the base member terminates adjacent the openings of the cover member as assembled together.

4. The combination according to claim 3, wherein the inner leg section of the cover member includes a lip in engagement with a terminal edge of the inner leg section of the base member.

5. The combination according to claim 2, further comprising a cap member affixed to the base and cover members as assembled together forming an end closure to the interior cavity.

6. The combination according to claim 1, wherein the cover member includes a spacer flange extending laterally from the inner leg section of the cover member for spacing of roofing elements on the roof structure a defined distance from the base and cover members as assembled.

7. The combination according to claim 1, wherein the outer leg section of the cover member includes a cleat for affixation of a fascia element or coping cap.

8. The combination according to claim 1, wherein the cover member includes a series of vents in the upper transverse section thereof.

9. In combination, a roof structure of a building wherein the roof structure has a corrugated roof deck for supporting a roofing material thereover and the roof structure defines a roof edge, and a system blocking the roof edge, wherein the roof edge blocking system comprises:

an elongate base member affixed to the roof deck along the edge of the roof structure, the base member being of a generally U-shaped cross-sectional configuration having a lower transverse section in superposed resting abutment on and affixed to the roof deck and spaced-apart inner and outer leg sections generally upstanding from opposite lateral sides of the lower transverse section, and an elongate cover member affixed over the base member, the cover member being of an inverted generally U-shaped cross-sectional configuration having an upper transverse section spanning across the leg sections of the base member and spaced-apart inner and outer leg sections depending from opposite lateral sides of the upper transverse section respectively extending downwardly along outward sides of the upstanding inner and outer leg sections of the base member, the base and cover members, as assembled together, forming an auxiliary perimeter structure on the roof structure for border containment of the roofing material.

10. The combination according to claim 9, wherein the roofing material is a flowable cementitious material.

11. The combination according to claim 9, wherein the roofing material is a rigid insulative material.

12. The combination according to claim 9, wherein the base and cover members, as assembled together, define an interior cavity and the respective inner leg sections of the base and cover members cooperatively define passageways into the cavity facing inwardly from the edge of the roof structure.

13. The combination according to claim 12, wherein the passageways permit flow of a cemetitious roofing material into the cavity.

14. The combination according to claim 12, wherein the inner leg section of the cover member is formed therealong with a series of openings and the inner leg section of the base member terminates adjacent the openings of the cover member as assembled together.

15. The combination according to claim 14, wherein the inner leg section of the cover member includes a lip in engagement with a terminal edge of the inner leg section of the base member.

16. The combination according to claim 12, further comprising a cap member affixed to the base and cover members as assembled together to form an end closure to the interior cavity.

17. The combination according to claim 9, wherein the cover member includes a spacer flange extending laterally from the inner leg section of the cover member for spacing of a rigid insulative roofing material a defined distance from the base and cover members as assembled.

18. The combination according to claim 9, wherein the outer leg section of the cover member includes a cleat for affixation of a fascia element or coping cap.

19. The combination according to claim 9, wherein the cover member includes a series of vents in the upper transverse section thereof.

20. The combination according to claim 9, further comprising an elongate closure strip affixed to the roof deck at the edge of the roof structure to dam a flowable cementitious roofing material in corrugations of the roof deck beneath the base member to prevent flow thereof off the edge of the roof structure.

* * * * *